US008800779B2

(12) United States Patent
Wardell

(10) Patent No.: US 8,800,779 B2
(45) Date of Patent: Aug. 12, 2014

(54) SCREEN SURFACE FORMING SYSTEM

(75) Inventor: Myron Henry Wardell, Lititz, PA (US)

(73) Assignee: Lumsden Corporation, Lancaster, PA (US)

( * ) Notice: Subject to any disclaimer, the term of this patent is extended or adjusted under 35 U.S.C. 154(b) by 338 days.

(21) Appl. No.: 13/067,890

(22) Filed: Jul. 5, 2011

(65) Prior Publication Data

US 2013/0008833 A1 Jan. 10, 2013

(51) Int. Cl.
*B07B 1/42* (2006.01)

(52) U.S. Cl.
USPC ..... 209/365.1; 209/363; 209/364; 209/404; 209/405; 209/412

(58) Field of Classification Search
USPC ..... 209/363, 364, 365.1, 392, 404, 405, 209/408, 410
See application file for complete search history.

(56) References Cited

U.S. PATENT DOCUMENTS 2,774,477 A 12/1956 Pollitz
4,670,136 A * 6/1987 Schmidt et al. ..... 209/403
5,829,599 A 11/1998 Woodgate
6,736,271 B1 * 5/2004 Hall ..... 209/409
7,152,743 B2 12/2006 Johnson et al.
7,296,685 B2 11/2007 Malmberg
7,637,378 B2 * 12/2009 Malmberg ..... 209/392
7,850,011 B2 12/2010 Fisher et al.
7,946,428 B1 * 5/2011 Lane et al. ..... 209/399
8,127,932 B2 * 3/2012 Trench et al. ..... 209/405

OTHER PUBLICATIONS

TEMA Isenmann, Inc.: WS85 Screens; WS85T™ Polyurethane Systems brochure, Lexington, KY, 2005.

* cited by examiner

*Primary Examiner* — Terrell Matthews
(74) *Attorney, Agent, or Firm* — Merek, Blackmon & Voorhees, LLC

(57) ABSTRACT

A screen system having a plurality of screen elements that can be readily removed and replaced to vary one or more characteristics of the screen surface formed by the screen system. The screen system includes a support system for supporting at least one screen element to prevent deformation of the screen element that typically would occur due to the insufficient structural stability of the at least one screen element relative to the weight of the product being screened. Preferably, the support system includes one or more support elements that can be readily and easily installed and removed from the screen system. The support system is preferably configured to permit the one or more support elements to be positioned at different locations in the screen system. Preferably, the support system is configured to permit a variety of different support elements to be used to allow a greater variety of screen elements to be used.

13 Claims, 9 Drawing Sheets

SCREEN SURFACE FORMING SYSTEM

FIELD OF THE INVENTION

The present invention is directed to a screen surface forming system that includes a plurality of individual screen elements that may be readily removed and replaced with one or more screening elements to readily modify one or more characteristics of the screen surface. In a preferred embodiment, the screen surface is formed by at least one screen element formed from mesh wire and another screen element formed from plastic. This preferred embodiment includes a support system for providing the necessary structural stability to prevent deformation of one or more screen elements that would deform in prior art screen systems due to the insufficient structural stability of the screen elements to support the weight of the product being screened without deforming. Hence, this preferred embodiment allows the screen surface forming system to utilize screen elements that typically could not be used to screen heavier product as the screen elements would deform due to the weight of the product.

BACKGROUND OF THE INVENTION

Screen surfaces formed from a plurality of screen elements are known. For example, the Isenmann WS-85 screen system includes a plurality of screen elements that can be removed and replaced. This screen system can use screen elements formed from plastic, namely polyurethane and metal screen elements. The Isenmann WS-85 screen system is disclosed in U.S. Pat. No. 4,670,136. However, this screen system has one or more significant disadvantages. For example, screen elements, particularly the metal screen elements can deform, e.g., sag between existing longitudinally extending carriers of the screen deck, due to the weight of the product being processed. Deformation of the screen element can render the screen element practically useless and in any event significantly less efficient. Therefore, a need exists for a screen system that will prevent deformation of the screen elements regardless of the material the screen element is formed from.

OBJECTS AND SUMMARY OF THE INVENTION

An object of the present invention is to provide a novel and unobvious screen system that includes a plurality of screen elements that can be readily removed and replaced to readily vary one or more characteristics of the screen surface formed by the screen system.

Another object of a preferred embodiment of the present invention is to provide a screen system that can accommodate screen elements of different structural stability and yet prevent deformation of any of the screen elements including screen elements that typically would be deformed due to the weight of the product being screened.

A further object of a preferred embodiment of the present invention is to provide a screen system with a support system for supporting one or more screen elements of the screen system where the support system prevents deformation of one or more screen elements that typically would deform due to the weight of the product being screened.

Yet another object of a preferred embodiment of the present invention is to provide a screen system with a support system for supporting one or more screen elements of the screen system where the support system can be readily and easily installed.

Still another object of a preferred embodiment of the present invention is to provide a screen system with a support system for supporting one or more screen elements of the screen system where the location of the support system can be readily and easily varied to support the screen elements that would typically deform due to the weight of the product being screened.

Yet still another object of a preferred embodiment of the present invention is to provide a screen system with a support system for supporting one or more screen elements of the screen system where the support system does not adversely affect the throughput of the screen system.

A further object of a preferred embodiment of the present invention is to provide a screen system with a support system for supporting one or more screen elements of the screen system where the support system is configured to prevent wear of the one or more screen elements to prolong the useful life of the one or more screen elements.

Yet still a further object of a preferred embodiment of the present invention is to provide a screen system with a support system for supporting one or more screen elements of the screen system where support elements of the support system can be readily modified to provide additional support to prevent deformation of one or more screen elements.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, a preferred embodiment of the present invention is directed to a screening support system for use with a vibrating screen for conducting material in a longitudinal direction while screening. The vibrating screen has a screening deck including a plurality of longitudinal carriers for carrying the screening support system. The screening support system includes a plurality of longitudinally extending support members. Each of the plurality of longitudinally extending support members are configured to be removably connected to a corresponding one of the plurality of longitudinal carriers of the screening deck of the vibrating screen. The plurality of longitudinally extending support members include a first longitudinally extending support member and a second longitudinally extending support member. The first longitudinally extending support member is spaced from the second longitudinally extending support member to receive a screening element therebetween. A plurality of transversely extending support members are configured to be removably connected to the first longitudinally extending member and the second longitudinally extending member. The plurality of transversely extending support members are disposed such that when a screen element is positioned between the first longitudinally extending support member and the second longitudinally extending support member each of the plurality of transversely extending support members are in contact with the screening element substantially along a width of the screening element to prevent the screening element from sagging.

Another preferred embodiment of the present invention is directed to a screening support system for use with a vibrating screen for screening material. The vibrating screen having a screening deck including a plurality of carriers for carrying the screening support system. The screening support system includes a plurality of screening element edge support members for supporting a plurality of screening elements having a plurality of openings formed therein through which a material to be screened passes. The plurality of screening element edge support members includes a first screening element edge support member having a first connecting member for removably connecting the first screening element edge support member to one of the plurality of carriers. The first screening element edge support member has a first outwardly extending segment for supporting thereon a first edge of a first screening element. A plurality of recesses are formed in the first outwardly extending segment. Each of the plurality of recesses is configured to receive a portion of one of a plurality of screening element section support members such that the first screening element edge support member extends at an angle to each of the plurality of screening element section support members. The plurality of screening element edge support members includes a second screening element edge support member connected to the first screening element edge support member to support the first edge of the first screening element between the first screening element edge support member and the second screening element edge support member.

A further preferred embodiment of the present invention is directed to a screening support system for use with a vibrating screen for screening material. The vibrating screen has a screening deck including a plurality of carriers for carrying the screening support system. The screening support system includes a plurality of screening element edge support members for supporting a plurality of screening elements having a plurality of openings formed therein through which a material to be screened passes. The plurality of screening element edge support members includes a first screening element edge support member having a first connecting member for removably connecting the first screening element edge support member to one of the plurality of carriers. The first screening element edge support member has a first outwardly extending segment for supporting thereon a first edge of a first screening element. A plurality of recesses are formed in the first outwardly extending segment. Each of the plurality of recesses being configured to receive a portion of one of a plurality of screening element section support members such that the first screening element edge support member extends at an angle to each of the plurality of screening element section support members.

Still a further preferred embodiment of the present invention is directed to a screening support system for use with a vibrating screen for screening material. The vibrating screen has a screening deck including a plurality of carriers for carrying the screening support system. The screening support system includes a plurality of longitudinally extending screening element support members for supporting a plurality of screening elements having a plurality of openings formed therein through which a material to be screened passes. The plurality of longitudinally extending screening element support members includes a first longitudinally extending screening element support member having a first connecting member for removably connecting the first longitudinally extending screening element support member to one of the plurality of carriers. A plurality of transversely extending screening element support members extend from the first longitudinally extending screening element support member for supporting at least one of the plurality of screening elements. Each of the plurality of transversely extending screening element support members has a first vertical surface. The first vertical surface of each of the plurality of transversely extending screening element support members abuts and extends along a first vertically extending side surface of the first longitudinally extending screening element edge support member and a first vertically extending side surface of the one of the plurality of carriers.

DETAILED DESCRIPTION OF THE PREFERRED EMBODIMENTS OF THE INVENTION

The preferred forms of the invention will now be described with reference to FIGS. 1-11. The appended claims are not limited to the preferred forms and no term and/or phrase used herein is to be given a meaning other than its ordinary meaning unless it is expressly stated that the term and/or phrase shall have a special meaning.

FIGS. 1-5

Referring to FIGS. 1 to 5, a screen system A formed in accordance with a preferred embodiment of the present invention is illustrated in one of many possible configurations. The screen system A may be used with a vibrating screen where the material being screened (e.g. stone, gravel, or other material that needs to be sized) travels in the longitudinal direction shown by arrow L. However, it will be readily appreciated that the present invention is not limited to use with vibrating screens where the material being screened moves in a longitudinal direction.

Figure 2:
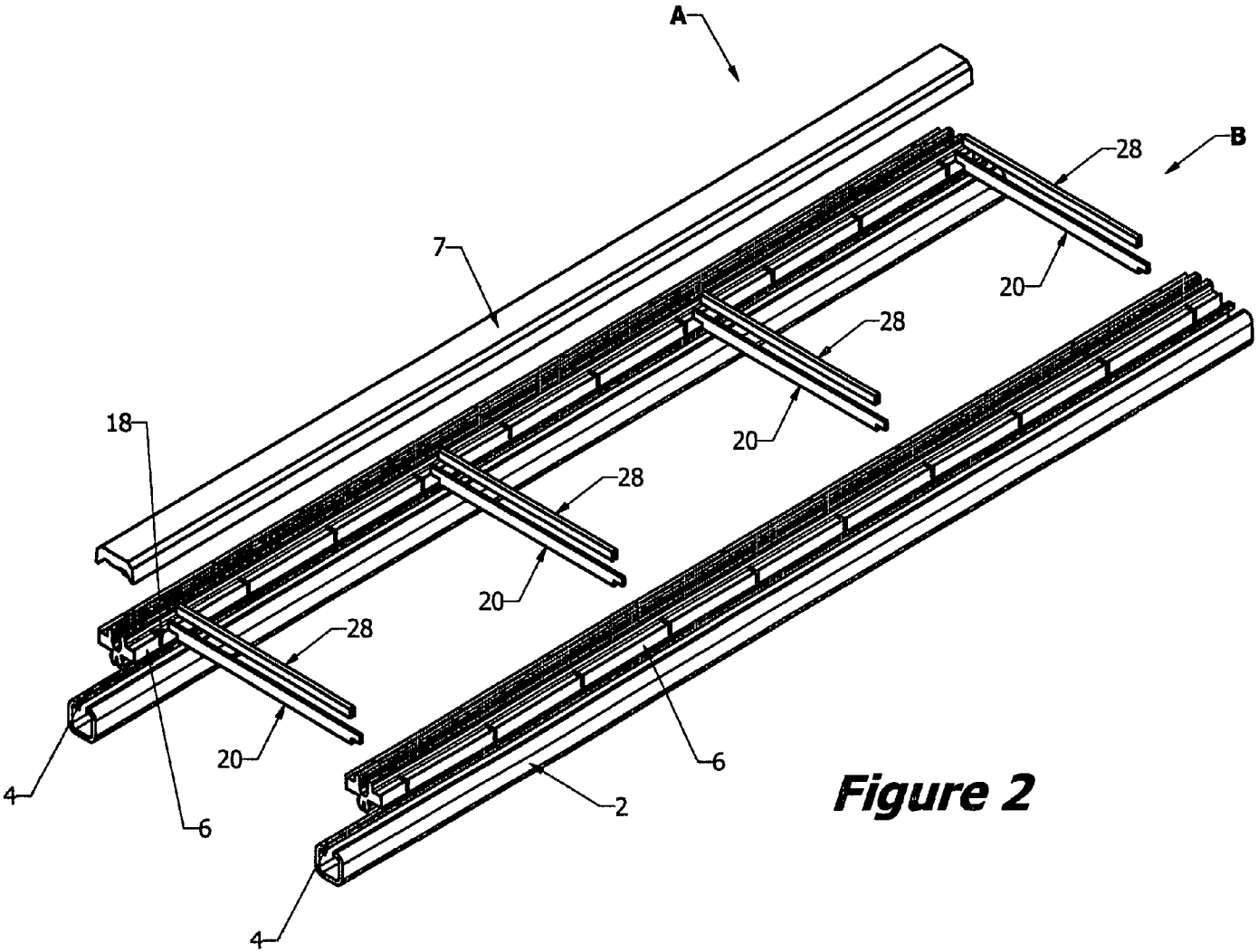
FIG. 2 is an exploded perspective view of the screen system illustrated in FIG. 1 without any screen elements.
Figure 3:
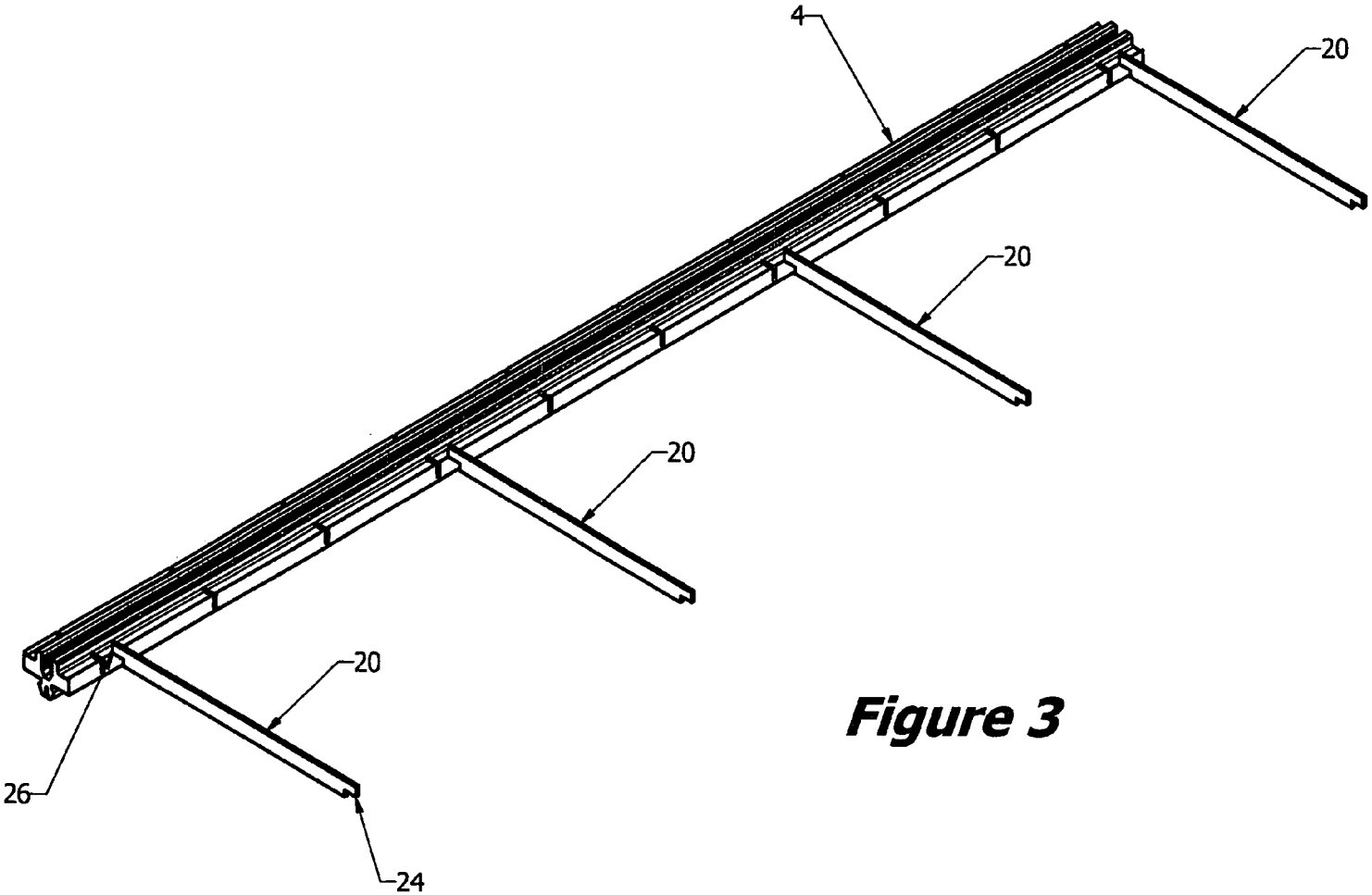
FIG. 3 is an exploded perspective view of one of the longitudinally extending support/securement members and a plurality of transversely extending support members/elements of the preferred form of the present invention with the transversely extending support members illustrated above the longitudinally extending support member.
Figure 5:
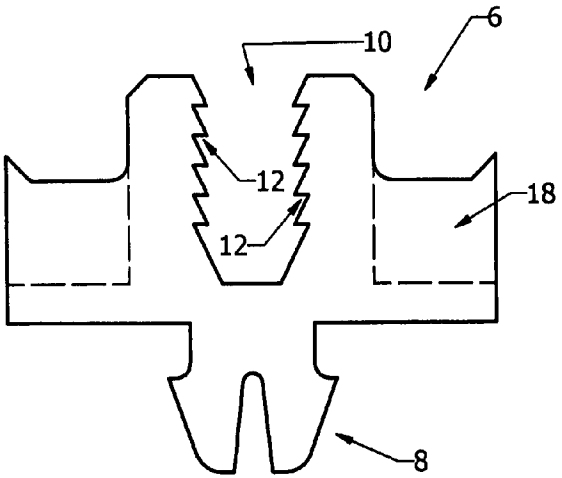
FIG. 5 is an enlarged end view of the longitudinally extending support member illustrated in FIG. 4.
Figure 4:
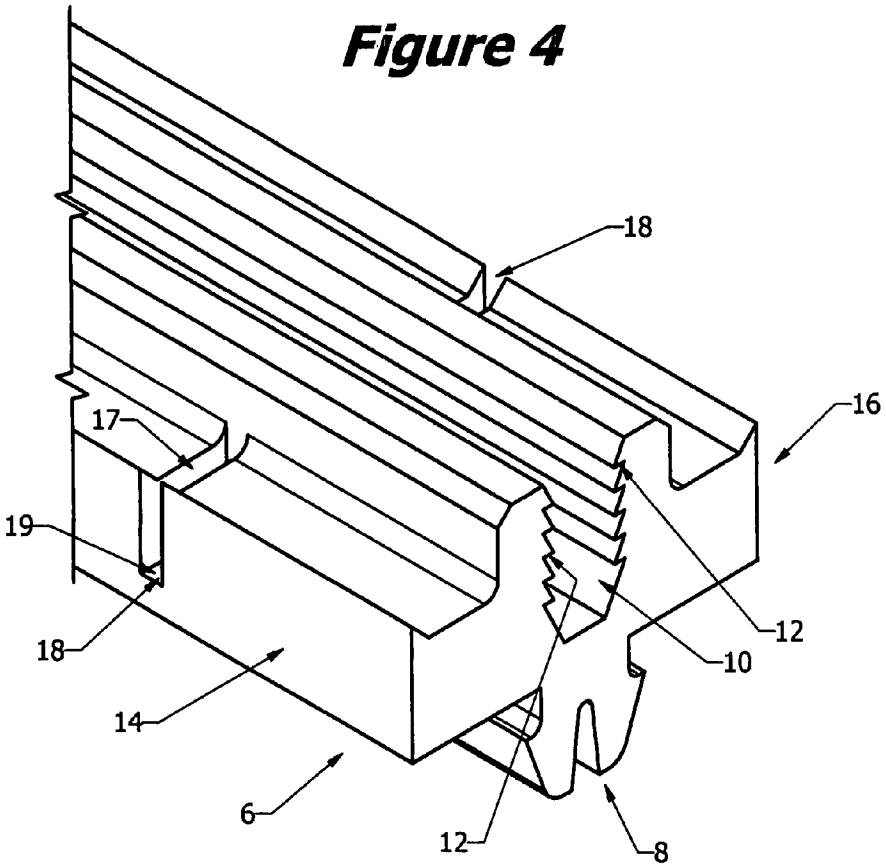
FIG. 4 is an enlarged fragmentary perspective view of one of the longitudinally extending support members of the preferred form of the present invention.

Screen system A includes a plurality of longitudinally extending carriers 2 that form a screen deck or substructure. Preferably, carriers 2 are formed from metal. However, any suitable material may be used. While only two carriers 2 are shown in FIGS. 1 to 5, additional carriers may be used to form a plurality of vertically extending spaces B between a pair of adjacent carriers 2 for receiving one or more screen elements C such that, the screen elements C extend between adjacent carriers 2. Screen elements C include a plurality of openings through which the product to be screened passes. An opening 4 is preferably formed in an upper surface of each carrier 2. The screen system A includes a support system for supporting one or more screen elements C in a secure manner on carriers 2. The support system includes a first screen edge element support member 6 and a second screen edge support member 7 operably associated with two or more carriers 2. While one support member 6 is shown without a corresponding support member 7, this is done solely so that the details of support member 6 can be readily seen. Preferably, cooperating support members 6 and 7 are formed from a plastic material, e.g., polyurethane. However, any suitable material may be used. First screen edge element support member 6 is preferably configured to be removably connected to a corresponding carrier 2. Specifically, as shown in FIGS. 4 and 5, first screen edge element support member 6 includes a longitudinally extending protrusion 8 that extends substantially the length of support member 6. Support member 6 is removably secured to a corresponding carrier 2 by inserting protrusion 8 into slot 4 of carrier 2. Support member 6 further includes a centrally located recess 10 that extends longitudinally along substantially the entire length of support member 6. Preferably, recess 10 includes a plurality of saw-tooth set backs 12. Preferably, support member 7 includes a downwardly extending protrusion having a configuration that will mate with recess 10 to removably secure support member 7 to support member 6. The downwardly extending protrusion preferably will have a similar construction to element 7 in U.S. Pat. No. 4,670,136. While one preferred structure for removably securing support member 6 to a corresponding carrier 2 and removably securing support member 7 to support member 6 has been described above, it will be readily appreciated that any other suitable structure may be used.

Referring to FIGS. 4 and 5, support member 6 may include outwardly extending screen element edge supports 14 and 16. While FIGS. 1 through 5 illustrate support member 6 as having two outwardly extending screen element edge supports 14 and 16, a support member 6 may only have one outwardly extending screen element edge support. The outwardly extending screen element edge supports 14 and 16 support a corresponding edge of adjacent screen elements. It will be readily appreciated that when support member 7 is secured to support member 6 a longitudinally extending edge of a corresponding screen element is securely held between support member 6 and support member 7. Outwardly extending screen element edge supports 14 and 16 preferably include a plurality of transversely extending slots 18. Slots 18 have an open upper area 17 and an open outer side area 19. Slots 18 are spaced along the longitudinal axis of support members 6. The number and size of the slots may be varied as desired.

Figure 1:
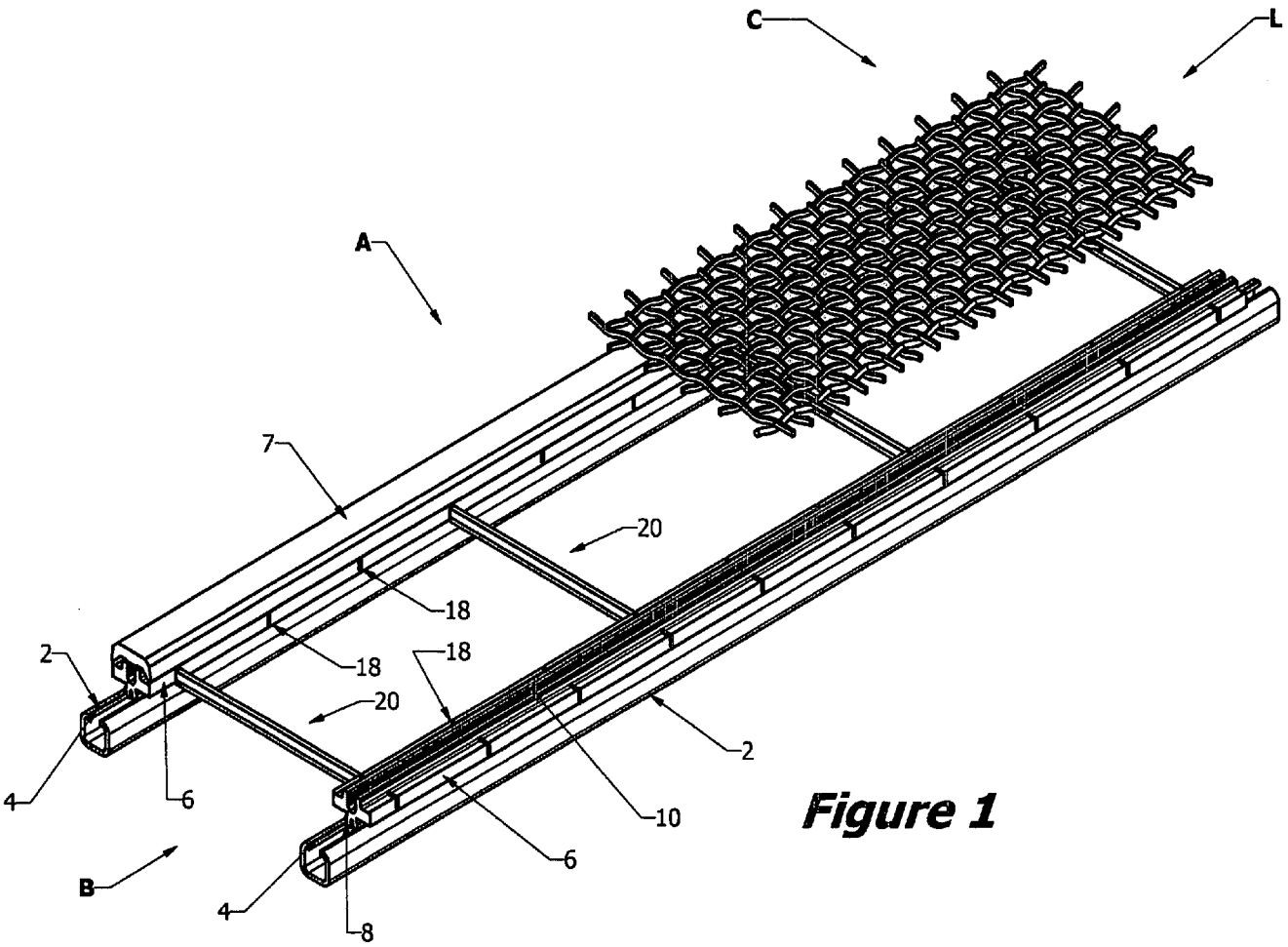
FIG. 1 is a perspective view of a portion of a screen system formed in accordance with a preferred embodiment of the present invention with a screen element shown above the screen system to permit the details of the screen system to be readily viewed.

Screen system A includes one or more screen body support members 20 that prevent a corresponding screen element from sagging. As seen in FIG. 1, members 20 extend transversely between adjacent longitudinally extending support members 6. Referring to FIGS. 2 and 3, screen body support members 20 include a body 22 and arms 24 and 26 extending outwardly from body 22. Arms 24 and 26 preferably have a substantially rectangular cross-section so that a given arm may be readily placed in a corresponding slot 18 through open areas 17 and 19. However, it will be readily appreciated that the configuration of support arms 24 and 26 may be varied along with the configuration of slots 18. Screen body support members 20 may be formed from metal. Where members 20 are formed from metal and support the body of a metal screen element, a protective cover 28 formed from plastic (e.g., polyurethane) may be positioned over a top edge of members 20 to prevent wear of the screen element C. However, it should be readily appreciated that members 20 can be formed from plastic to avoid any need for a protective cover. A member 20 may be readily installed by placing arm 24 in slot 18 of a support member 6 and arm 26 in an aligned slot 18 of an adjacent support member 6. Where member 20 is made of plastic or no protective cover is used, the underside of a screen element C preferably rests directly on top of member 20. Where a protective cover is used, the underside of the screen element preferably rests directly on top of the protective cover. In either case, member 20 prevents the screen element from sagging. As seen in FIG. 1, the location of members 20 can be readily varied by simply inserting a given member 20 into a different pair of aligned slots 18 formed in adjacent support members 6. Also as shown in FIG. 1, a member 20 need not be placed in each pair of aligned slots 18 of adjacent support members 6. Further, member 20 could also extend at angle other than ninety degrees to the adjacent support members 6.

FIGS. 6-11

Referring to FIGS. 6 to 11, alterative forms to the most preferred form illustrated in FIGS. 1 to 5 will now be described. It should be noted that the present invention is not limited to the preferred form illustrated in FIGS. 1 to 5 or the alternative forms disclosed in FIGS. 6 to 11.

Figure 6:
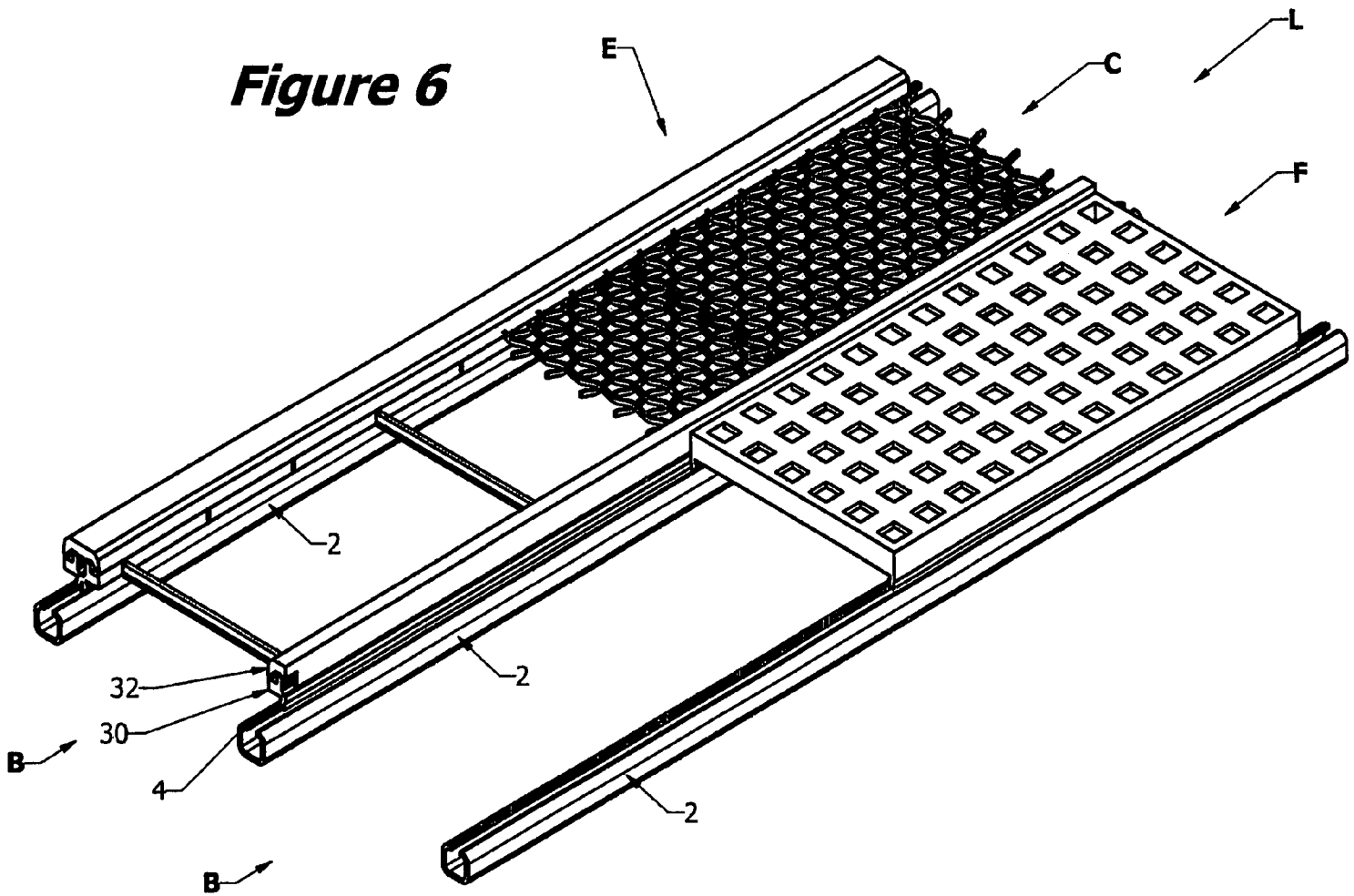
FIG. 6 is a perspective view of a portion of a screen system formed in accordance with another preferred embodiment of the present invention.

Referring to FIG. 6, an alternative form of the present invention will now be described. Screen system E is similar to screen system A and, therefore, on the differences will be described in detail. The screen system E includes at least three carriers 2 forming two vertically extending spaces B for receiving one or more screen elements. In this embodiment, the screen elements include at least one screen element C formed from metal wire and at least one other screen element F formed from a plastic material (e.g., polyurethane). Support/securement members 30 and 32 extend between screen element C and screen element F. Support member 30 includes a protrusion similar to protrusion 8 of the preferred form of the invention illustrated in FIGS. 1 to 5 allowing support member 30 to be removably secured to a corresponding carrier 2. Support member 30 further includes a central recess similar to recess 10 to receive a mating element of support member 32 so that support member 32 can be removably secured to support member 30. However, as seen in FIG. 6, support members 30 and 32 lack a second outwardly extending screen element edge support so that a lower lip of plastic screen element F can extend into slot 4 to removably secure one side of screen element F to centrally located carrier 2. In this manner, the screen system E can utilize one or more screen elements C while simultaneously utilizing one or more screen elements F.

Figure 7:
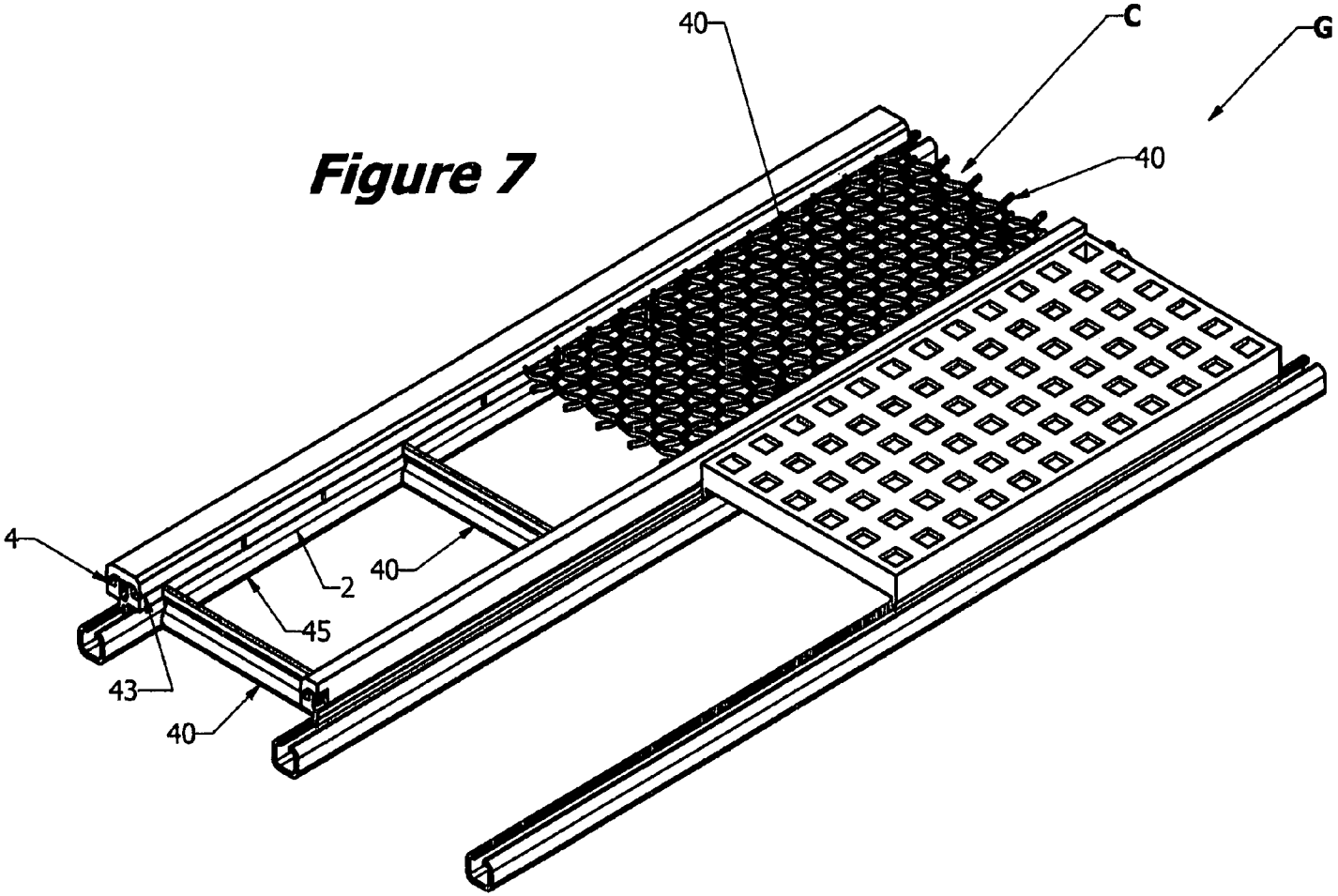
FIG. 7 is a perspective view of a portion of screen system formed in accordance with a further preferred embodiment of the present invention.
Figure 8:
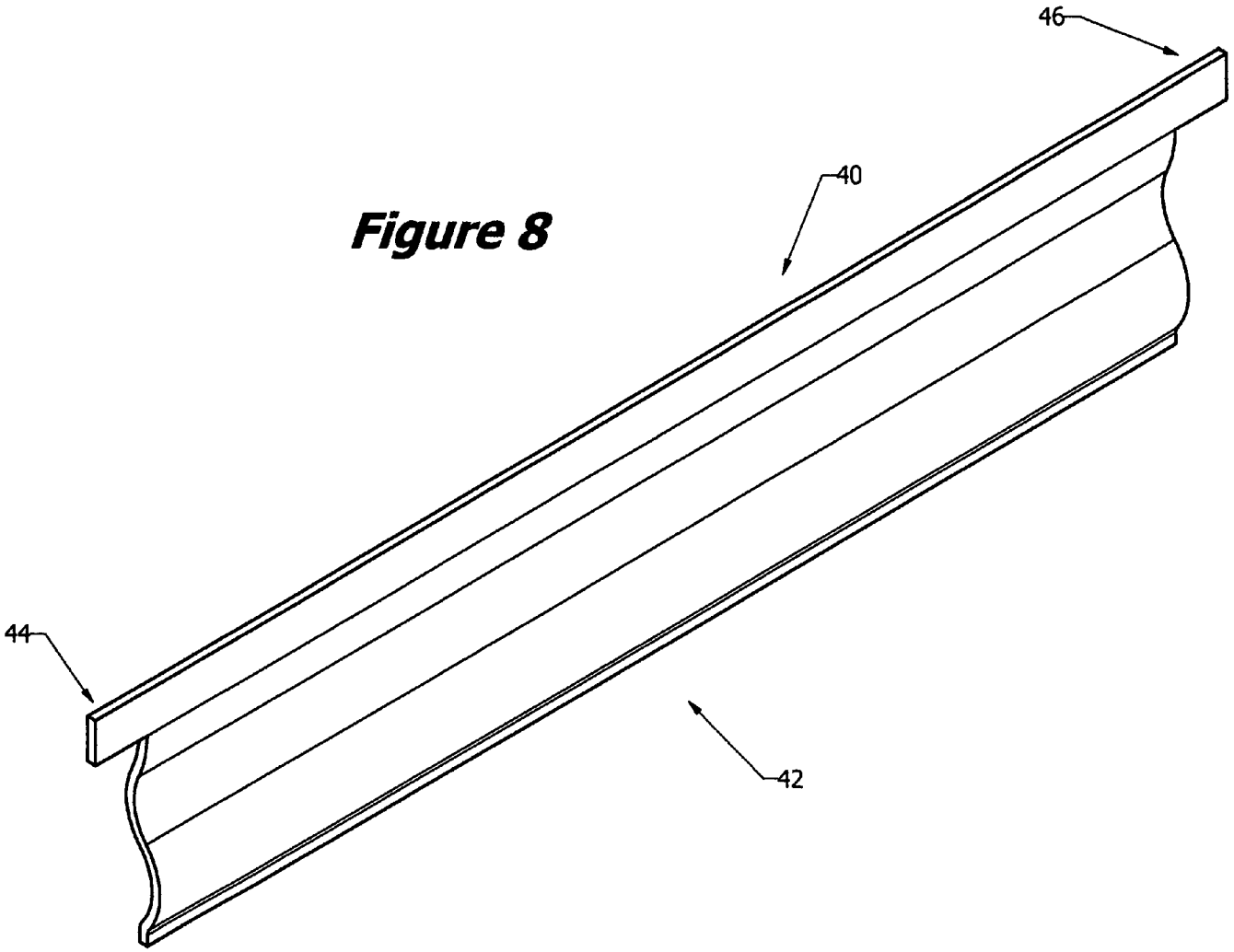
FIG. 8 is a perspective view of one of the transversely extending support members of the embodiment illustrated in FIG. 7.
Figure 10:
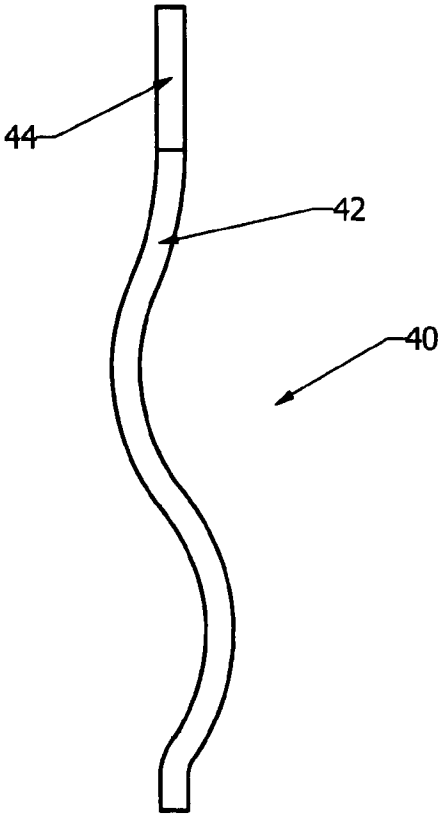
FIG. 10 is an end view of the transversely extending support member illustrated in FIG. 8.

Referring to FIGS. 7, 8 and 10, a further alternative form of the present invention will now be described. Screen system G is similar to screen system E and, therefore, only the differences will be described in detail. The screen system G includes one or more screen body support members 40 that prevent a corresponding screen element from sagging. As seen in FIG. 7, members 40 extending transversely between adjacent longitudinally extending support members 6 supporting one or more screen elements C. Referring to FIG. 8, screen body support members 40 include a body 42 and arms 44 and 46 extending outwardly from body 42. Arms 44 and 46 have the same configuration as arms 24 and 26. As opposed to the planar body 22 of the preferred form, body 42 has a serpentine configuration. Preferably, the body 42 extends along at least a portion of the vertically extending side surface 43 of support member 6 and at least a portion of vertically extending side surface 45 of carrier 2. The serpentine configuration provides even greater structural stability to support a screen element to prevent deformation. Because arms 44 and 46 have the same configuration as arms 24 and 26, support member 40 can readily replace a support member 20 or can be used in the same screen system as support members 20 without modifying any other element of the screen system. Preferably, support members 40 are formed from plastic. However, if formed from metal a plastic protective cover may be used. It should be noted that members 40 may not be necessary to support plastic screen elements F due to their structural stability.

Figure 9:
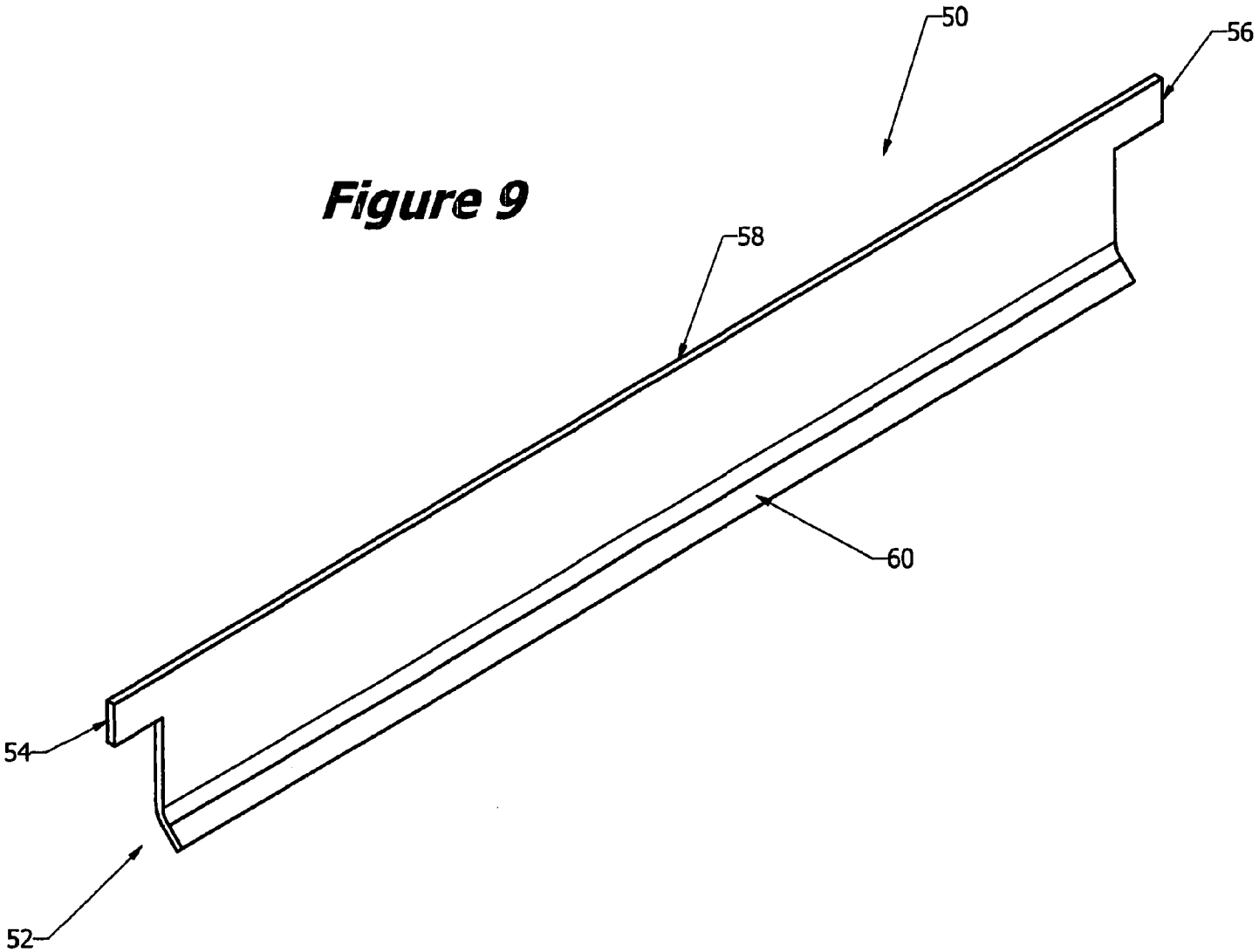
FIG. 9 is a perspective view of another form of the transversely extending support member.
Figure 11:
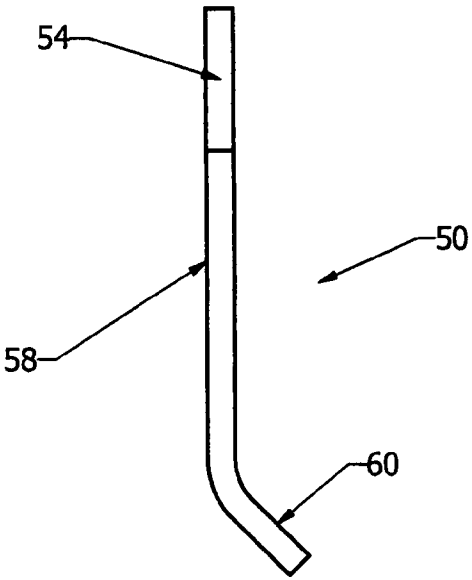
FIG. 11 is an end view of the transversely extending support member illustrated in FIG. 9.

Referring to FIGS. 9 and 11, a further alternative form of transversely extending support member will now be described. Support members 50 extend transversely between adjacent longitudinally extending support members 6 in a similar manner to support members 20 and 40. Referring to FIGS. 9 and 11, screen body support members 50 include a body 52 and arms 54 and 56 extending outwardly from body 52. Preferably, arms 54 and 56 have the same configuration as arms 24 and 26 and arms 44 and 46. Body 52 includes an upper portion 58 and a lower portion 60 forming an angle less than 180 degrees. This body construction also provides greater structural stability. Because the arms 54 and 56 have the same configuration as arms 24 and 26 and arms 44 and 46, support members 50 can replace either support members 20 or 40 and/or can be used in the same screen system as support member 20 and/or support member 40. Preferably, support members 50 are formed from plastic. However, if formed from metal a plastic protective cover may be used.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiments described in connection with FIGS. 1 to 11 and have been written to preclude such a narrow construction using the principles of claim differentiation.

I claim:

1. A screening support system for use with a vibrating screen for screening material, the vibrating screen having a screening deck including a plurality of carriers for carrying said screening support system, said screening support system including:

(a) a plurality of screening element edge support members for supporting a plurality of screening elements having a plurality of openings formed therein through which a material to be screened passes, said plurality of screening element edge support members including a first screening element edge support member having a first connecting member for removably connecting said first screening element edge support member to one of said plurality of carriers, said first screening element edge support member having a first outwardly extending segment for supporting thereon a first edge of a first screening element, a plurality of recesses are formed in said first outwardly extending segment, each of said plurality of recesses being configured to receive a portion of one of a plurality of screening element section support members such that said first screening element edge support member extends at an angle to each of said plurality of screening element section support members, said first connecting member and said first outwardly extending segment being formed as one piece.

2. A screening support system as set forth in claim 1, wherein:

(a) said first connecting element forms a lowermost portion of said first screening element edge support member.

3. A screening support system as set forth in claim 2, wherein:

(a) each of said plurality of recesses extend transversely and are disposed above said first connecting element.

4. A screening support system as set forth in claim 3, wherein:

(a) each of said plurality of recesses is a slot having an open upper area, a closed bottom area, an open outer side area and a closed inner side area.

5. A screening support system for use with a vibrating screen for screening material, the vibrating screen having a screening deck including a plurality of carriers for carrying said screening support system, said screening support system including:

(a) a plurality of longitudinally extending screening element support members for supporting a plurality of screening elements having a plurality of openings formed therein through which a material to be screened passes, said plurality of longitudinally extending screening element support members including a first longitudinally extending screening element support member having a first connecting member for removably connecting said first longitudinally extending screening element support member to one of said plurality of carriers; and, (b) a plurality of transversely extending screening element support members extending from said first longitudinally extending screening element support member for supporting at least one of said plurality of screening elements, each of said plurality of transversely extending screening element support members having a first vertical surface, said first vertical surface of each of said plurality of transversely extending screening element support members extends along a first vertically extending side surface of said first longitudinally extending screening element edge support member and a first vertically extending side surface of said one of said plurality of carriers.

6. A screening support system as recited in claim 5, wherein:

(a) each of said plurality of transversely extending screening element support members includes a body having a first side and a second side, a first support arm extending outwardly from said first side of said body and a second support arm extending outwardly from said second side of said body, said first support arm and said second support arm each include a lower surface extending substantially parallel to a screening surface formed by said plurality of screening elements, said lower surface of said first support arm rests on a support surface of said first longitudinally extending screening element support member, said support surface of said first longitudinally extending screening element support member extends substantially parallel to the screening surface formed by said plurality of screening elements, said lower surface of said second support arm rests on a support surface of a second longitudinally extending screening element support member, said support surface of said second longitudinally extending screening element support member extends substantially parallel to the screening surface formed by said plurality of screening elements.

7. A screening support system as recited in claim 6, wherein:

(a) said body of each of said plurality of transversely extending screening element support members includes a reinforcing segment for preventing deformation of a corresponding transversely extending screening element support member.

8. A screening support system as recited in claim 7, wherein:

(a) said reinforcing segment has a serpentine configuration.

9. A screening support system as recited in claim 7, wherein:

(a) said reinforcing segment forms an angle greater than 0 degrees and less than 180 degrees with an upper portion of said body.

10. A screening support system as recited in claim 7, wherein:

(a) said reinforcing segment forms an angle greater than 90 degrees and less than 180 degrees with an upper portion of said body.

11. A screening support system for use with a vibrating screen for screening material, the vibrating screen having a screening deck including a plurality of carriers for carrying said screening support system, said screening support system including:

(a) a plurality of screening element edge support members for supporting a plurality of screening elements having a plurality of openings formed therein through which a material to be screened passes, said plurality of screening element edge support members including a first screening element edge support member having a first connecting member for removably connecting said first screening element edge support member to one of said plurality of carriers, said first screening element edge support member having a first outwardly extending segment for supporting thereon a first edge of a first screening element, a plurality of recesses are formed in said first outwardly extending segment, each of said plurality of recesses being configured to receive a portion of one of a plurality of screening element section support members such that said first screening element edge support member extends at an angle to each of said plurality of screening element section support members; and, (b) a plurality of transversely extending screening element support members for supporting at least one of said plurality of screening elements, each of said plurality of transversely extending screening element support members having a first portion seated in a corresponding one of said plurality of recesses, each of said transversely extending screening element support members being separate pieces from said plurality of screening elements so that:

(i) a configuration of the screening support system can be readily modified to vary the number of transversely extending screening element support members in the screening support system without varying the number of screening elements; and, (ii) each of the plurality of transversely extending screen element support members can be installed prior to installation of the corresponding screening elements.

12. A screening support system as recited in claim 11, wherein:

(a) said plurality of screening element edge support members and said plurality of transversely extending screening element support members being configured such that each of said plurality of extending screening element support members can be removed from the corresponding recess by raising vertically each of said plurality of extending screening element support members without moving horizontally.

13. A screening support system as recited in claim 11, wherein:

(a) each of said plurality of screening element edge support members being configured such that no portion is disposed directly above any portion of said recesses.

* * * * *